US005255488A

United States Patent [19]

Johnson et al.

[11] Patent Number: 5,255,488

[45] Date of Patent: Oct. 26, 1993

[54] TIE-WIRE FOR CONCRETE FORM

[76] Inventors: Kevin Johnson, Box 64, Quitno Rd., Malta, Ill. 60150; Brent Johnson, 2737 S. Daysville Rd., Oregon, Ill. 61061

[21] Appl. No.: 870,946

[22] Filed: Apr. 20, 1992

[51] Int. Cl.[5] ..... E04G 17/06

[52] U.S. Cl. ..... 52/741.1; 52/98; 249/38; 249/40; 249/216

[58] Field of Search ..... 52/699, 427, 442, 426, 52/438, 562, 565, 98, 741.1; 249/38, 40, 41, 42, 214, 216, 20, 22, 33, 36, 44, 45, 191, 195

[56] References Cited

U.S. PATENT DOCUMENTS 2,920,371 1/1960 Shoemaker ..... 249/214
3,010,175 11/1961 Shoemaker ..... 249/41
4,545,163 10/1985 Asselin ..... 249/40

*Primary Examiner*—Michael Safavi
*Attorney, Agent, or Firm*—Kajane McManus

[57] ABSTRACT

The wall tie comprises a length of wire and includes a plurality of flattened areas thereon defined between end shoulders for each. A locking arm on concrete forms engaged about the tie engages over an outer half of a chosen flattened portion, and engages adjacent forms together. To keep the form from encroaching into the portion of the flattened area to be engaged by the locking arm, the outer half of each flattened area incorporates a stop member which, when abutted against an outwardly directed surface of the form, eliminates the need for repositioning of the form to allow for appropriate engagement of the locking arm thereover.

1 Claim, 3 Drawing Sheets

TIE-WIRE FOR CONCRETE FORM

BACKGROUND OF THE INVENTION

1. Field of the Invention

The present invention pertains to an improved tie-wire for use in constructing rough concrete walls, such as for a home foundation. More particularly, the tie-wire includes structure thereon which engages the form used in defining the concrete wall, keeping the form from encroaching into an adjacent locking arm engaging area on the tie-wire.

2. Prior Art

Heretofore various embodiments of wall tie-wires or tie-rods have been proposed for use in creating a rough concrete wall. Concrete foundation walls are generally poured between two sets of forms disposed in essentially parallel relationship and defining therebetween a channel having a dimension for the desired thickness of the concrete wall. Such opposed, spaced apart walls are generally held in a fixed relationship against the immense weight of the poured concrete by tie-wires or rods having abutment surfaces against which locking or latching arms on adjacent form sections abut.

The most widely used type of tie-rod is a so-called "button end" tie-wire which has a washer-like member swaged to the ends thereof to provide a flange which acts against a wedge-like member having an elongated slot with an enlarged key at one end thereof. These tie-rods extend through openings in spaced apart form sections and carry dish-shaped washers which bear against the inside of the form sections and hold the sections against relative movement toward each other. The tie-rods may extend outwardly of the sections four to eight inches to accommodate so-called waling strips running horizontally behind the form section and stiff backing running vertically behind the waling. A wedge or dog is then fitted over the button end and the waling and stiff backing is held between the form walls and the dog to rigidize and reinforce the form walls.

These button end tie-wires are relatively expensive to form. The production thereof requires the forming of two flattened portions, positioning of the dished washers adjacent the flattened portions, positioning of smaller washers adjacent the ends thereof, and swaging of the rod on opposite sides of the end washer.

Another form of wires or rods used in a forming system wherein latching members for engaging adjacent form sections are pivotally mounted to the form sections comprises a length of wire or rod stock which has been flattened either throughout its length or at the extremities thereof in a first plane to form a generally rectangular cross-section and then within the area of first flattening has been formed in a perpendicular plane so as to form indentations perpendicular to the first planes and flanges or abutment surfaces adapted to be engaged by the latching members on the concrete form sections.

This type of tie-wire has enjoyed popularity and is a relatively inexpensive. disposable item.

Examples of such wall ties are found in the following U.S. Patents:

| U.S. Pat. No. | Patentee |
|---|---|
| 2,898,659 | Shoemaker |
| 2,920,371 | Shoemaker |
| 3,010,175 | Shoemaker |

-continued

| U.S. Pat. No. | Patentee |
|---|---|
| 3,055,076 | Van Halden et al |
| 3,746,297 | Daniels, Jr. |
| 3,767,158 | Milkus |

The Shoemaker U.S. Pat. Nos. 2,898,659; 2,920,371 and 3,010,175 all disclose a tie-wire have a plurality of flats provided thereon for receiving a form engaging pivotable clip or latching member thereover for interengaging form sections used to define a concrete structure, such as a wall, to be poured.

The Van Helden et al U.S. Pat. No. 3,055,076 discloses concrete form locking means which include tie-wires similar to those of Shoemaker. The locking means comprise slotted tie-bars for receiving and engaging headed ends of the tie-wires.

The Daniels, Jr. U.S. Pat. No. 3,746,297 discloses a tie-wire for concrete forms, the tie-wire comprising a length of wire having a portion of substantially cross section area adjacent the end thereof outwardly subtended by an annular flange of greater diameter than the wire, the flanges apparently eliminating form blowout by weight of concrete poured thereinto.

The Milkus U.S. Pat. No. 3,767,158 discloses a concrete form construction incorporating tie-wires or bars which are generally circular in cross section. Shoulder pairs are formed at each end of the bar which engage therein latch arms of the form sections for securing adjacent form sections together.

None of the above described tie-wires include means thereon for stopping the forms engaged thereto from encroaching into the area of the tie-wire to which the latch or clip is to be engaged.

Such encroachment causes difficulties in erecting the forms; the laborer spending significant amounts of time hammering the forms toward the center of the tie-wires, so that the latch engaging areas of the tie-wires are accessible, and the hammering the latch members down over and into appropriate engagement with the tie-wires.

If the need for such realignment of the forms relative to the tie-wires could be eliminated, a significant time and manpower saving could be appreciated.

As will be described in greater detail hereinafter, the improved wall tie of the present invention incorporates means thereon which insure proper alignment of the forms along the tie-wires, eliminating the need to readjust positioning thereof to obtain access to the latch engaging areas of the tie-wire.

SUMMARY OF THE INVENTION

An object of the present invention is to provide an improved tie-wire for concrete forms and a method of making same.

Another object of the invention is to provide an improved tie-wire which incorporates means thereon assuring proper alignment of concrete forms relative thereto.

A further object of the invention is to provide a tie-wire which significantly decreases labor involved in placement of same.

A still further object of the invention is to provide a significant saving in time required in engaging the tie-wires to the forms.

These and other objects and advantages are met by providing a tie-wire which incorporates stop members appropriately positioned thereon which do not allow the concrete form to encroach into the latch engaging area thereof while not interfering with appropriate engagement of the latch to the tie-wire.

DESCRIPTION OF THE PREFERRED EMBODIMENT(S)

Figure 1:
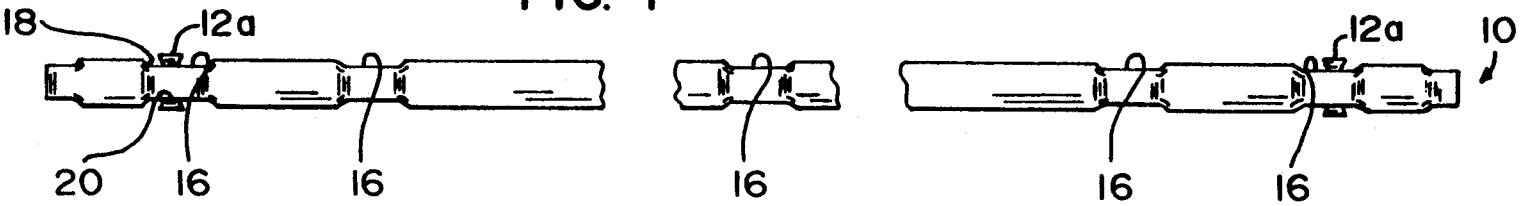
FIG. 1 is a top plan view of one embodiment of the improved tie-wire of the present invention including stop tabs thereon.

In creating a poured concrete wall, such as that often provided in a basement, a plurality of concrete form structures used to define inner and outer surfaces of the concrete wall to be poured are aligned to define a space between parallel sections having a predetermined thickness, in known manner.

The spacing between corresponding parallel form structures is maintained by use of spacer pins or tie-wires, which, when used in conjunction with latch members in the form of locking levers on the form structures, also serve to join adjacent form structures together, also in known manner.

The tie-wires each comprise a predetermined length section preferably of semi-hard wire which is flattened in a horizontal plane over a length of the section.

The tie-wire is then subjected to a second squeeze or flattening throughout a shorter length at the same location relative to each end thereof in a vertical plane to define an inner and outer shoulder at each end of the vertically flattened portion.

A plurality of such formations are provided in each tie-wire, preferably with two at each end in spaced relationship, to accommodate creation of concrete walls of various thickness, depending on which pair of formations is used.

After concrete has been poured into the channel formed between the parallel forms and set and the forms are to be stripped away, a wrench is applied to the flats so the extremities of the tie-wires left protruding at the outer shoulders can be twisted away, loosening the levers so they can be disconnected from the tie-wires.

The levers hold the tie-wires positioned so that the ends can be twisted off as described.

Engagement of the levers over the tie-wires also acts to engage adjacent form sections together.

In this respect, each lever is pivotally engaged to one form and has a length which allows the free end to engage against a portion of the second or adjacent form to maintain alignment between the forms.

This lever includes a slot therein which engages over the extremity of the tie-wire positioned between the forms, the lever slot engaging the tie-wire by locking into the flattened portions of the tie-wires to maintain the levers from sliding outwardly along the length of the tie-wires under the weight of the concrete pushing outwardly against the forms.

When the ties are seated between the form sections, prior to engaging the levers thereto, the forms often lean outwardly and encroach into the area where the levers are to engage.

If such encroachment takes place, much time is spent hammering against the form section to reposition it so that the lever can engage within the corresponding slot on the tie-wire.

To eliminate the need for repositioning of the form for lever engagement, the tie-wires 10 of the present invention propose incorporation of a stop member 12 thereon which will maintain alignment of the form for easier lever engagement, with the stop member 12 being separated from the tie-wire 10 upon engagement of the lever 14 thereover.

Two basic embodiments **12*a* and 12*b* are proposed for the stop members 12**.

In the first embodiment **12*a*, it is proposed to form a tab 12*a* within a portion of each flat 16 where a lever 14 could engage during formation of the tie 10**.

In the second embodiment **12*b* of the stop member 12, it is proposed to provide a clip 12*b* which functionally engages over the tie 10 in the same position as proposed for tab 12*a***.

Figure 2:
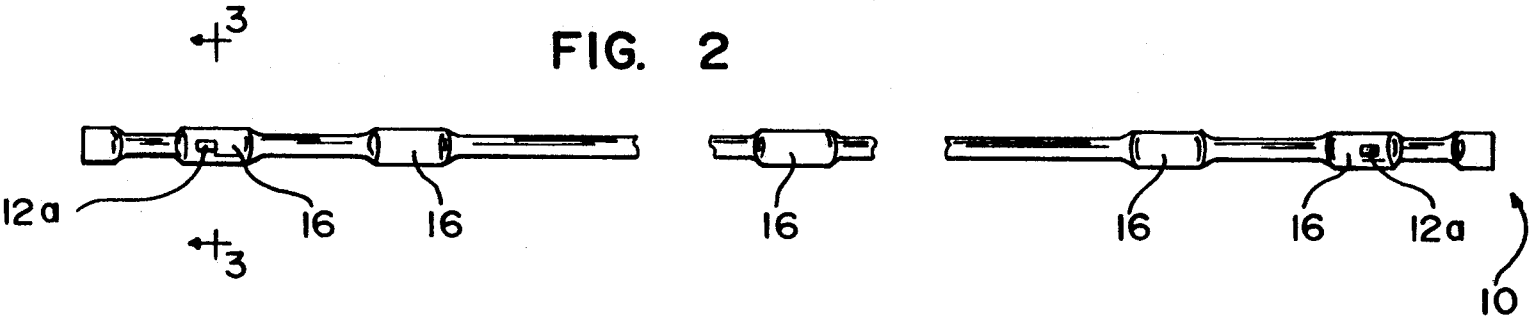
FIG. 2 is a side view of the tie-wire of FIG. 1.
Figure 3:
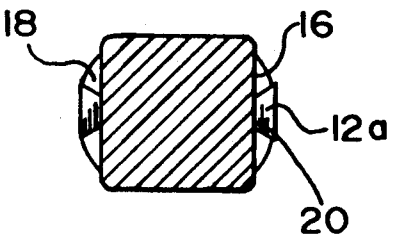
FIG. 3 is a cross sectional view through the tie-wire and is taken along line 3—3 of FIG. 2.
Figure 4:
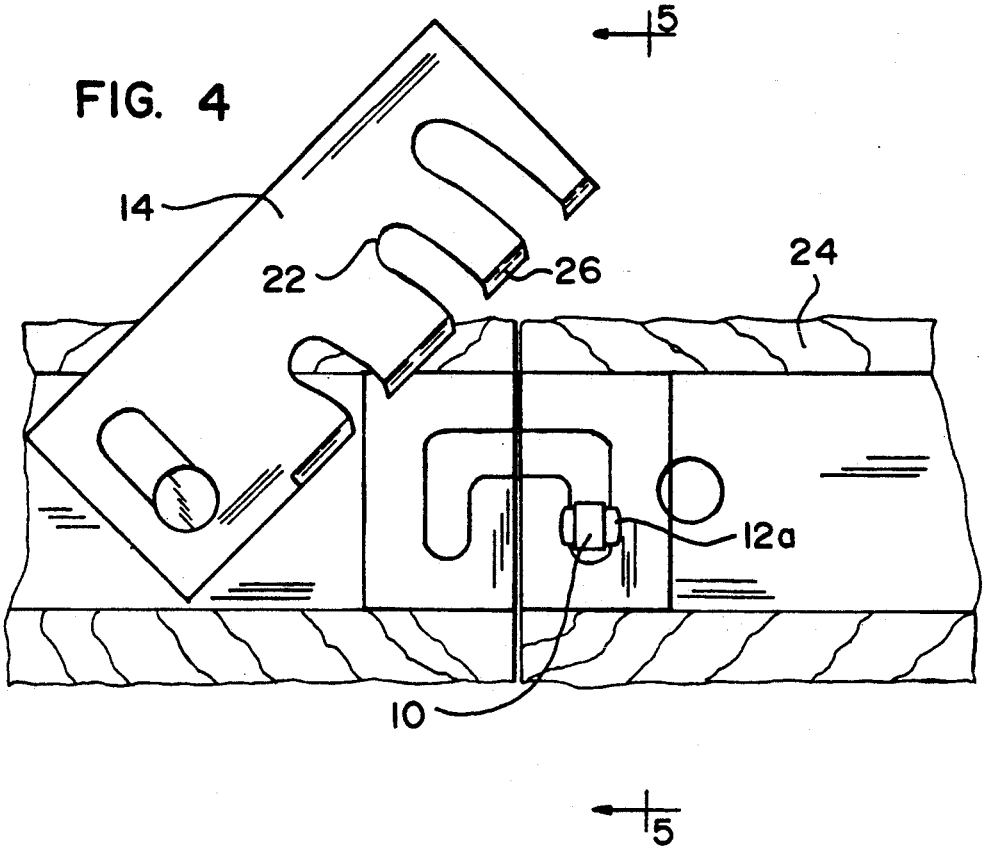
FIG. 4 is a front view of a portion of a concrete form showing the tie-wire engaged thereto with a clip of the form ready to be engaged thereover.
Figure 5:
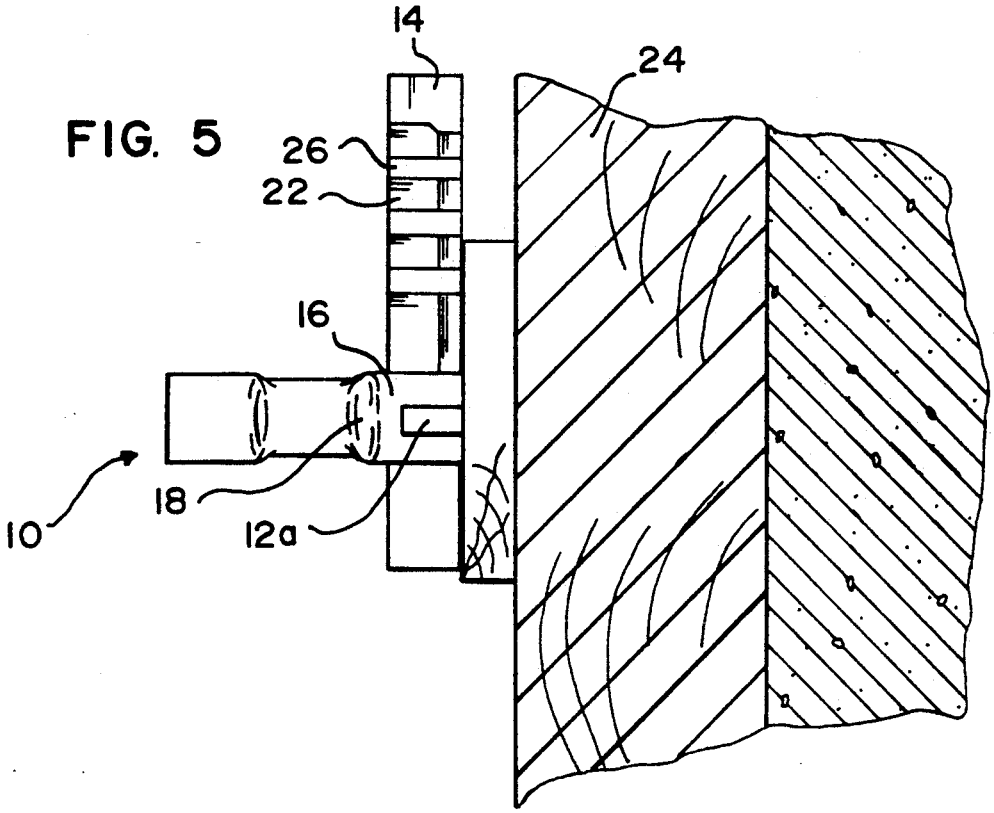
FIG. 5 is a side view of the elements shown in FIG. 4 and is taken along line 5—5 of FIG. 4 and shows the tie-wire with the clip positioned to be engaged thereover, the clip shearing the stop tab off the tie-wire upon engagement thereover.

As shown in FIGS. 1 through 5, the tab **12*a* is created within a flat 16, near an outer shoulder 18 thereof, in the position which the lever 14** will assume when it is engaged thereover.

Provision of the tab 12 a within the flat 16 maintains the form positioned inwardly thereof, maintaining its position and eliminating the need to reposition it. The tab **12*a* has a structure, to be described, which allows it to shear off the tie-wire 10 when the lever 14 is hammered into engagement over the tie-wire 10**.

As shown, tab **12*a* is a narrow triangular member which appears to have one point thereof buried within the material of the tie-wire 10. Provision of such a small base for the tab 12*a* assures ease in shearing the tab 12*a* off the tie 10 by the lever 14** action.

Alternatively, the area of joining at 20 between the tab **12*a* and the tie 10 could be perforated for easing the shear. Even though not illustrated, it will be understood that a tab 12*a* may be located within each flat 16 along the length of the tie-wire 10**.

Figure 6:
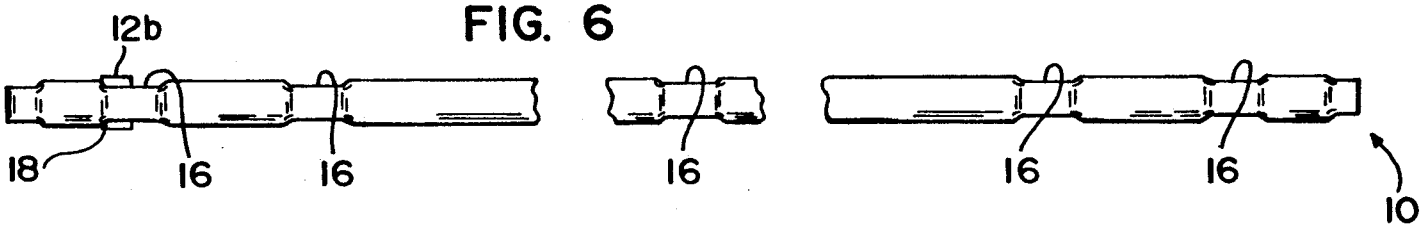
FIG. 6 is a top plan view of a second embodiment of the tie-wire, this embodiment incorporating a separate stop member fictionally engaged to the tie-wire.
Figure 7:
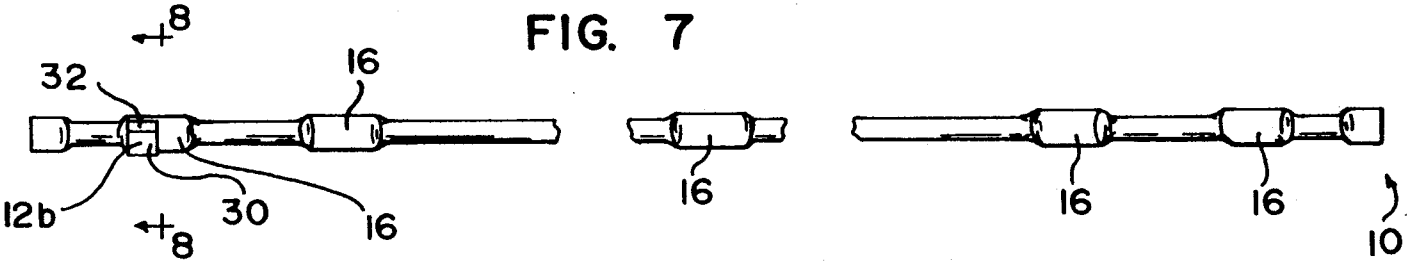
FIG. 7 is a side view of the tie-wire and stop member of FIG. 6.
Figure 10:
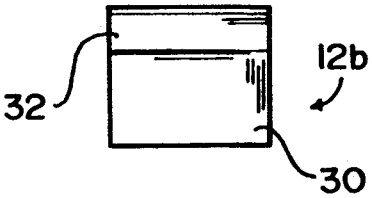
FIG. 10 is a side view of the stop member.
Figure 9:
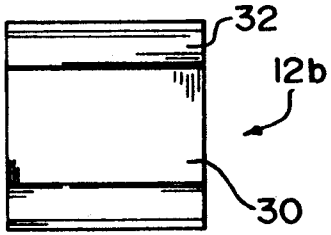
FIG. 9 is a top plan view of the stop member.
Figure 8:
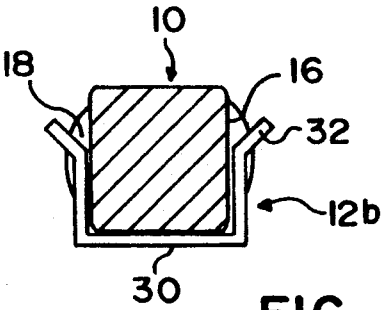
FIG. 8 is a cross sectional view taken along line 8—8 of FIG. 7.

Turning now to FIGS. 6–10 the stop member **12*b* is formed separate from tie-wire 10** and is press fitted thereon.

The stop member **12*b* is substantially U shaped and is formed to have a resiliency such that it maintains engagement with the tie-wire 10** until disengagement is desired, as will be defined hereinafter.

The clip **12*b* frictionally engages over the flat area 16. The U-shaped base 30 terminates in upwardly and outwardly directed terminal flanges 32. The clip 12*b* is of a height which is less than that of the flat area 16** so that it is not easily removable therefrom.

Because a frictional engagement is necessary between the tie-wire 10 and the clip 12*b*, the clip 12*b* is preferably formed of metal or plastic which is easily manipulated into a compression fit.

With this clip 12*b*, the lever 14 again acts to disengage the clip 12*b* from the tie-wire 10 upon engagement to the tie-wire 10, as will be further defined hereinafter.

When the lever 14 is hammered into a locking position, with slot 22 formed therein engaging about the tie-wire 10 the walls defining the slot abut against the outer defining shoulder 18 of the flattened area 16 to keep the forms 24 from bowing outwardly once concrete is poured therebetween.

Also, the stop means 12*a* and 12*b* are severed from engagement with the tie-wire 10 by a leading edge 26 of the lever 14, the triangular stop member 12*a* being severed away, and the clip 12*b* merely being pushed off.

Thus, the stop members 12*a* and 12*b* do not interfere in disassembly of the form once the concrete has hardened.

As described above, the improved tie-wire 10 of the present invention has a number of advantages, some of which have been described above and others of which are inherent in the invention.

Also, modifications can be proposed to the tie-wire 10 without departing from the teachings herein. Accordingly, the scope of the invention need only be limited as necessitated by the accompanying claims.

We claim:

1. A method for using a tie-wire having flat areas adapted to engage locking means on a concrete form and including a stop member extending across an outer half of the flattened areas, said method including the steps of: aligning adjacent form members; engaging a wall tie to and between edges of parallel corresponding form members; causing the stop members to abut against the outwardly directed surface of the form members to keep same from encroaching thereover; and engaging locking means on one form member over said tie-wire and cooperating locking elements on an adjacent form; said locking means shearing said stop member away from the tie-wire upon engagement thereover.

* * * * *